United States Patent [19]

Seaton et al.

[11] 4,201,070

[45] May 6, 1980

[54] GRAPHITE LUBRICANT APPLICATION METHOD

[75] Inventors: John J. Seaton, Greentree Borough; James K. Slagle, Washington Township, Westmoreland County, both of Pa.

[73] Assignee: United States Steel Corporation, Pittsburgh, Pa.

[21] Appl. No.: 947,967

[22] Filed: Oct. 2, 1978

Related U.S. Application Data

[62] Division of Ser. No. 730,410, Oct. 7, 1976, Pat. No. 4,132,096.

[51] Int. Cl.[2] ..... B21B 17/04; B21B 45/02

[52] U.S. Cl. ..... 72/42; 72/45

[58] Field of Search ..... 72/41, 42, 43, 44, 45, 72/96, 97, 208, 209; 252/29

[56] References Cited

U.S. PATENT DOCUMENTS

| | | | |
|---|---|---|---|
| 1,471,669 | 10/1923 | Miller | 72/45 |
| 3,561,238 | 2/1971 | Tetzloff et al. | 72/45 X |
| 3,605,473 | 9/1971 | Lyon et al. | 72/43 X |
| 3,747,385 | 7/1973 | Meurer et al. | 72/97 |
| 3,763,679 | 10/1973 | Lane et al. | 72/45 X |
| 3,924,437 | 12/1975 | Hortig | 72/349 |
| 3,927,547 | 12/1975 | Schonfeld et al. | 72/97 |
| 4,001,125 | 1/1977 | Newton | 252/29 |

*Primary Examiner*—Ervin M. Combs

*Attorney, Agent, or Firm*—William A. Danchuk

[57] ABSTRACT

A graphite lubricant system for applying a coating of the lubricant to successive mandrels in a seamless pipe mill just prior to their insertion therein. The system provides for the selective application of the smokeless lubricant to the mandrels before they are inserted within the seamless pipe shell and both are run into the mill itself. In order to prevent the lubricant from clogging, the system includes a self-flushing arrangement which provides a cleaning function thereto when the system has been inactive for a given amount of time.

2 Claims, 3 Drawing Figures

GRAPHITE LUBRICANT APPLICATION METHOD

This is a division, of application Ser. No. 730,410, filed Oct. 7, 1976, now U.S. Pat. No. 4,132,096.

BACKGROUND OF THE INVENTION

Seamless pipe mills have been employed for a good many years for producing seamless steel tubular products. These continuous rolling mills are generally constructed having a plurality (usually nine) of tandem individually powered stands of two-high grooved rolls. The rolls in the consecutive stands have their axes at 90 degrees to each other. The seamless pipe mill requires an internal mandrel against which the work piece is rolled to reduce wall thickness. This cylindrical mandrel extends entirely through a pierced billet (also known as a shell) and passes through the mill with the work piece. In the first two roll stands, the diameter of the pierced shell is reduced so that the inner surface is in substantial contact with the mandrel bar. Successive stands of rolls each make reductions in the wall of the shell with reductions getting less with each successive roll. By the ninth stand, there is very little reduction, the major purpose being to plane the tube surface. The shape of the tube which has been oval in the proceeding stands is changed to circular by the ninth stand. The rounding up operation effected by this stand frees the inner surface of the tube from the mandrel bar to facilitate the withdrawal of the mandrel therefrom.

In the operation of the mill, after a billet has been pierced by a conventional Mannesmann piercing mill, a lubricated mandrel, considerably longer than the pierced shell, is inserted and both pass through the rolling mill. The tube and mandrel are then kicked out of the pass line to a stripper which mechanically removes the mandrel.

The lubricant which is applied to the mandrel bar is employed for the purpose of alleviating any tendency of the tube to stick to the mandrel. These "stickers" are undesirable insofar as they require additional time to strip the tube from the mandrel and may, if sticking becomes a serious enough problem, result in the necessity to destroy the tube in order to remove the mandrel. It should be obvious that such counterproductive operations cannot be long tolerated. Heretofore, the lubricant used for coating the mandrel bar was black oil. The use of black oil was successful and has been recognized as the lubricant for mandrel bars. Black oil, however, is a hydrocarbon and produces thick deleterious smoke when burned (as happens when the lubricant is applied to the mandrel and the latter is inserted into the hot shell). The level of smoke in the mills became dangerous to the health and safety of the employees of the mill even though it worked very well in keeping mills loads constant and alleviating stickers.

The Environmental Protection Agency (EPA) and the Occupational Safety and Health Act (OSHA) both have direct bearing upon the above-noted situation. Specifically, the EPA objected to the use of black oil, or any hydrocarbon lubricant, in the mill for the obvious reason that the smoke produced polluted the surrounding atmosphere. The promulgators of OSHA expressed the same type of concern for the workers forced to breath the smoke and work in the reduced visibility environment resultant from such use. The only solution available was to find a substitute for the black oil which was not a smoking hydrocarbon and which did not present other disadvantages or safety problems.

An initial testing period conducted by applicants resulted in a finding that a graphite and water dispersion on the order of 15 percent graphite is ineffectual. Sticking and pinning occurs shortly after testing of several graphite lubricants commenced. Applicants then, after conducting an in depth research study on the problem, decided that an extremely high non-colloidal graphite dispersion in water might be effective. Colloidal graphite cannot be used because it is inherently too fine and does not fill the irregularities in the mandrel bars sufficiently to prevent sticking. The remaining problem concerns how to apply a high graphite dispersion to a mandrel bar as it enters the shell and is run through the rolls of the mill at speeds approximating 600 feet per minute. The specific solution to this problem is the subject of the present application.

SUMMARY OF THE INVENTION

The present invention is addressed to a system and method of applying a heavy graphite lubricant, having a great propensity to clog and stick, to a moving mandrel adapted for use within a continuous seamless pipe mill. The system provides a pumping network including a spraying system for atomizing the lubricant and directing the same toward the moving mandrel. Switches are provided for automatically turning the system on and off, as the mandrel approaches a given point and leaves another given point relative to the application system, respectively. In a preferred embodiment of the invention, the application system is employed in conjunction with a cleaning system which is essential for preventing clogging of the application system by the heavy and thick graphite/water lubricant. The cleaning system employs a selective water flush arrangement which, subsequent to a given period of inactivity of the application system, completely flushes the same with water, thereby precluding the lubricant from clogging the system.

The water flush system, in another embodiment, is configured to provide the above-noted cleaning operation whenever the application system is not functioning to apply the graphite and water dispersion to a mandrel employed in the seamless pipe mill. Accordingly, the application system is either applying graphite or is being cleaned for insuring a non-clogged condition.

The application system according to the present invention includes specifically designed spray nozzles which are operative to efficiently and effectively apply the graphite dispersion to successive mandrels. The nozzle allows the rather sluggy graphite to be atomized and sprayed onto the moving mandrel. Moreover, the nozzle design aids in keeping the spray nozzles from clogging during the spraying operation.

Accordingly, it is a primary object and feature of the present invention to provide an application system for selectively applying a lubricant mixture to a moving mandrel adapted for use within a continuous seamless pipe mill, the lubricant mixture being characterized in having a propensity to clog.

It is a general object and feature of the present invention to provide a graphite lubrication application system for a continuous seamless pipe mill, the application system including a self-cleaning arrangement for cleaning the system of lubricant subsequent to a given period of inactivity of the system for preventing the clogging of the application system by the lubricant.

It is another general object and feature of the present invention to provide a graphite lubrication application system for a continuous seamless pipe mill, the application system including a self-cleaning arrangement for cleaning the system of lubricant whenever the system is not applying lubricant, for preventing the clogging of the application system by lubricant.

It is another object and feature of the present invention to provide an application system for the selective application of a lubricant mixture to a seamless pipe mill, the system being characterized in having spray nozzles which are configured to promote the spraying of a heavy sludge-like lubricant within the pipe mill.

Other objects and features of the invention will, in part, be obvious and will, in part, become apparent as the following description proceeds. The features of novelty which characterize the invention will be pointed out with particularity in the claims annexed to and forming part of the specification.

BRIEF DESCRIPTION OF THE DRAWINGS

The novel features that are considered characteristic of the invention are set forth with particularity in the annexed claims. The invention itself, however, both as to its structure and its operation, together with the additional objects and advantages thereof, will best be understood from the following description of the preferred embodiment of the invention when read in conjunction with the accompanying drawings wherein:

DETAILED DESCRIPTION OF THE INVENTION

Figure 1:
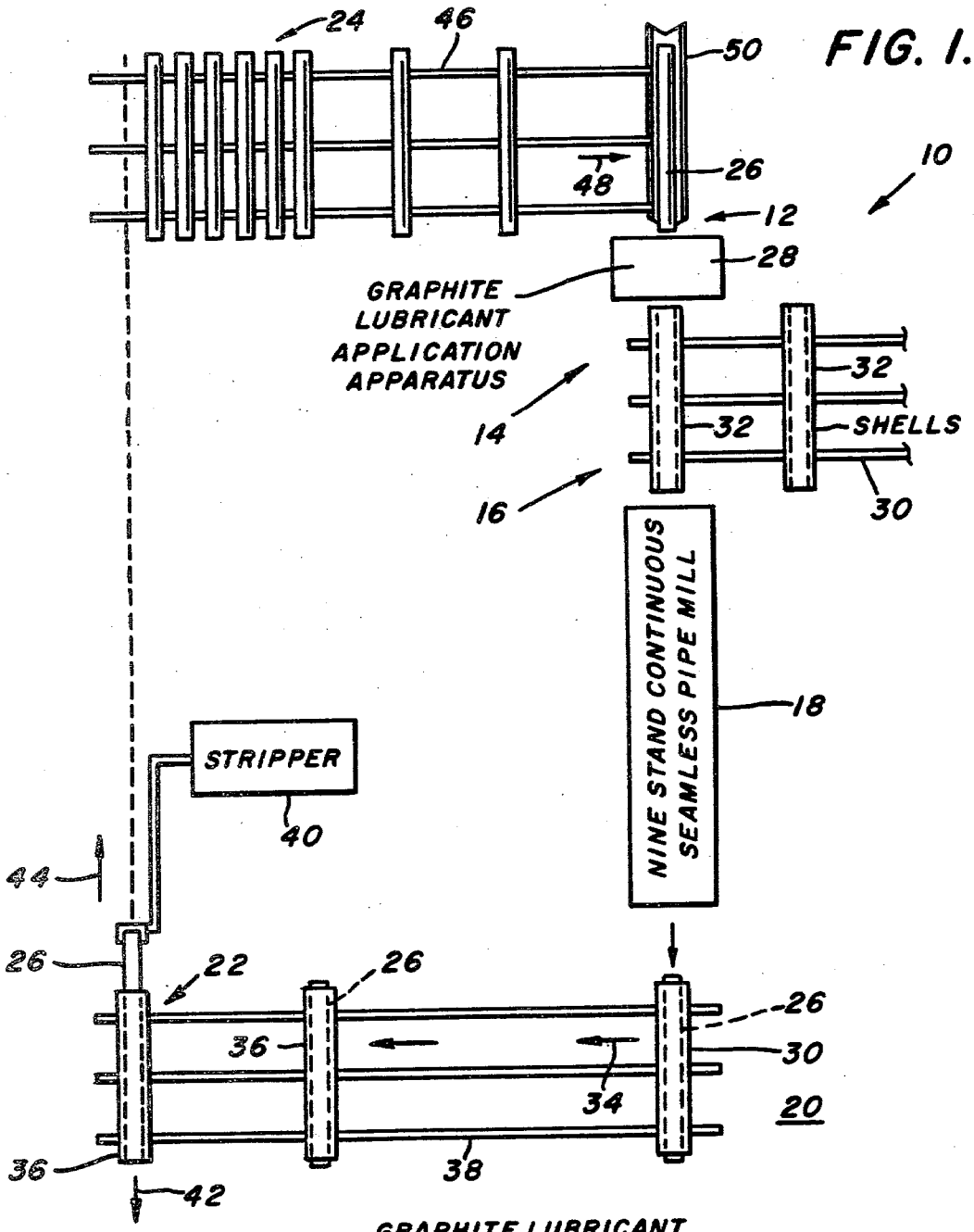
FIG. 1 is a diagrammatic representation of the major relevant component elements of a continuous seamless pipe mill incorporating the application system according to the present invention.

The relevant components of a continuous seamless pipe mill are shown in schematic form in FIG. 1. The mill, generally indicated at 10, includes a mandrel bar preparation station 12, a lubricant application area 14, and a shell insertion station 16 immediately prior to the mine stand mill itself. The mill itself is shown in schematic form at 18. The downstream side of the total mill 10 includes an exit area 20, a stripper area 22 and a mandrel bar cooling area 24 from which mandrel bars are moved toward the ready station 12 to be re-inserted within another shell.

In operation, a set of mandrel bars (usually between 12 and 16 bars) is moved successively through the entire mill 10. In order to better understand how the present lubrication system works, a full circuit for one single mandrel bar will be described. A mandrel bar, an example of which is shown at 26 in the ready station 12, is moved, by a chain conveyor upon which it sits, toward the graphite lubrication application 28 which senses the presense of a mandrel bar moving toward it and applies a coating of the 50/50 graphite/water lubricant to the bar. The apparatus 28 also includes, as will be described below, another sensing device which shuts the application apparatus off as the bar 26 leaves the graphite lubrication station 14 and moves toward the shell insertion area 16. Shells, which are rounded billets which have been pierced, are sent from the piercer (not shown) down a ramp 30 toward the area 16 where the lubricated mandrel bar 26 is inserted into the shell 32. The combined shell and mandrel are then sent through the continuous seamless pipe mill 18 in which the shell is reduced in wall size but is extended in length over almost the entire length of the 63 foot mandrel bar from an initial shell length of between 15 to 25 feet. The resultant tube 36 and mandrel exit into area 20 and then begin a lateral movement, indicated by arrow 34, down a ramp 38 toward a stripping station 22. A stripping apparatus or machine 40 engages one specifically formed end of the mandrel 26 and pulls it from the stationary held tube 36. The tube is subsequently moved away (in the direction indicated by arrow 42) for further processing while the mandrel bar 26 is moved in the direction of arrow 44.

The mandrel bar 26 is heated to temperatures approximating 190° F. as it and the tube exit from the mill 18. The stripped bar has a temperature of between 120°–140° F. as it continues on its way to the cooling area 24 where bars are collected and cooled (usually by water spray units). This cooling process reduces the bar temperature to between 80°–100° F. at which temperature the bar is re-inserted into another shell. Successive cooled bars are moved from the cooling area 24 down a ramp 46 in the direction indicated by arrow 48 to a receiving trough 50 from which point the process just described is repeated.

The process just described is specifically designed to gradually reduce bar temperatures in a particular manner for retaining the straightness of the mandrel bars and for preventing their incorrect cooling and resultant warping. It should also become apparent that the lubricant application is important for facilitating the removal of the mandrel from the "finished" tube and for creating a superior product interior which is substantially free from defects. As noted previously, black oil has been used for lubricating the mandrels in a seamless pipe mill. However, due to the amount of pollution caused by such use, as well as the increase costs involved in such use over the last few years, it has been necessary to resort to other lubricants such as graphite. To date, however, the graphites employed in other fields have been found to be of insufficient weight to adequately coat a mandrel bar in such a way as to prevent sticking and provide for good product. Recently, graphite dispersions having a 50/50 graphite to water ratio have been developed for speciality uses. One example of such a product is that developed by Grapho Colloids Corporation and labeled lubricant #150-4. This product is the subject of a pending application for United States Patent, Ser. No. 584,722 filed June 9, 1975 by Archibald R. Newton, III, the application being assigned to the Grapho Colloids Corporation of Sharon, Pa.

While the graphite lubricant just discussed is characterized in having sufficient weight to provide an adequate coating to the mandrels, it has a correlative disadvantage in being of a weight that it has a characteristic viscosity of sludge or mud. Accordingly, the graphite lubricant which is sufficient to adequately coat the bars for the purposes just denoted is hard to apply and is difficult to keep from clogging most applicators employed. The lubricant may be applied to some degree, by methods other than spraying although such methods are grossly wasteful and are neither effective nor practical. It should be remembered that the mandrels are moved through the application apparatus at relatively fast speeds. Accordingly, spraying the lubricant upon the mandrel is one method which would appear to satisfy most of the requirements in this regard. Applicants' experience in this type of application was subject to extreme problems of applying the heavy sludge by sprays and, moreover, was plagued by their inability to keep any such system from clogging up both during applications and just subsequent thereto when the system was inactive. The present application system solved these problems and resulted in an efficient and practical way of achieving the results desired.

Figure 2:
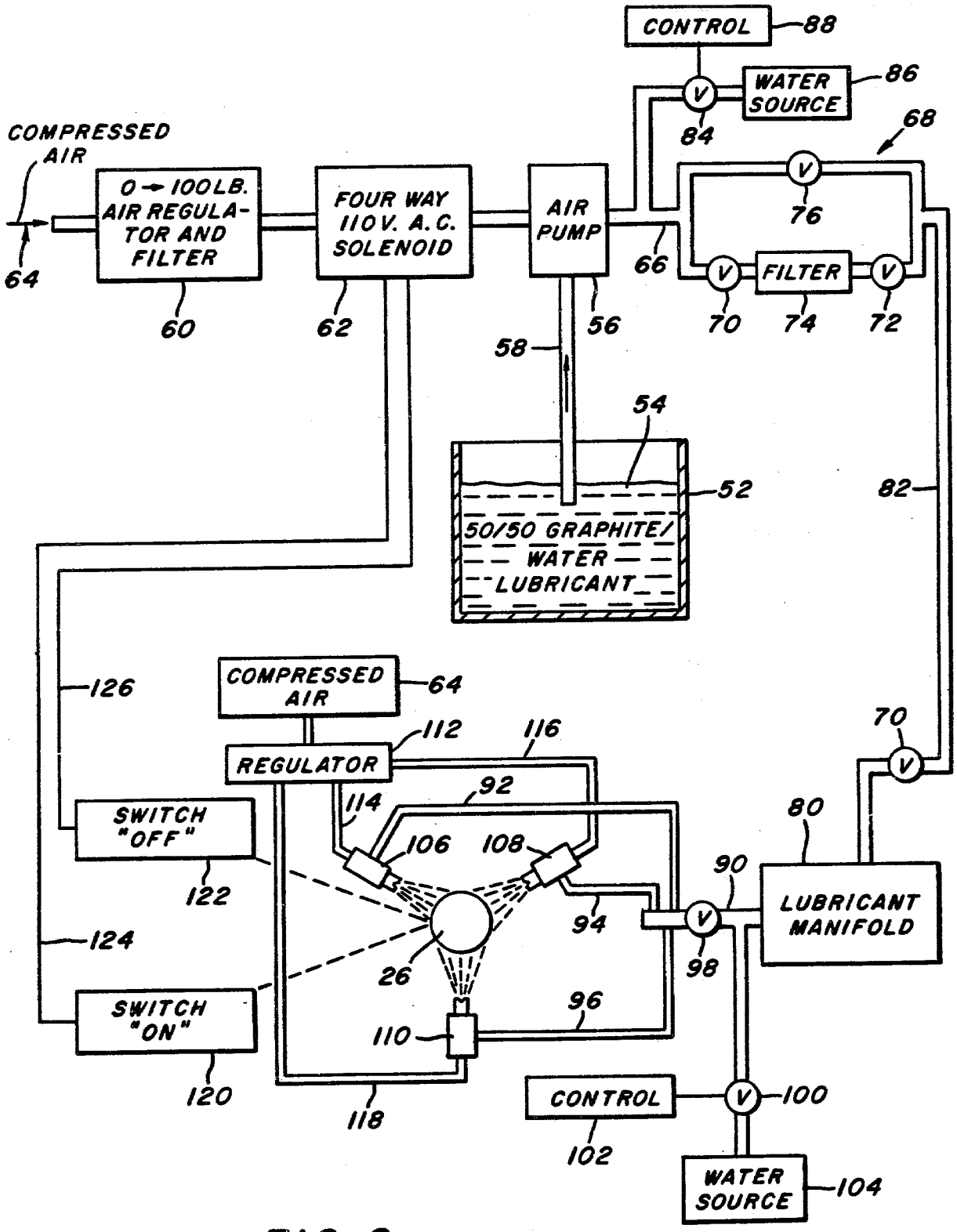
FIG. 2 is schematic representation of a preferred embodiment of the application system of the present invention.

Looking to FIG. 2, there is shown one embodiment of a graphite lubricant application system according to the present invention. The basis of the system begins with a storage facility or tank 52 which is used to retain a quantity of graphite and water lubricant mixture 54. An air pump 56, connected to the mixture 54 through a pipe or conduit 58 pumps the mixture from the tank 52 to the applicating portion of the system. The control of the mixture being applied to the application portion of the system is accomplished by an air regulator and filter 60 and a solevoid 62. The regulator 60 is connected to a source of compressed air 64 and regulates the amount and pressure of air passing to the air pump to drive the same. The amount of the mixture pumped by the pump 56 is directly proportional to the air pressure driving the pump from the regulator 60. Different sized mandrels require different amounts of the mixture therefore necessitating control of the pump output for conservation purposes. The solevoid 62 is an "on/off switch" for the air pump and will be discussed in more detail as the description continues. The mixture pumped by pump 56 continues toward the application portion through a pipe 66 to a filter and purge system 68. The system 68 includes a first valve 70 and a second valve 72, both of which are normally open. Positioned between these two valves is a filter 74. A third valve 76 is located on the remaining arm of the circuit and is normally closed. Accordingly, the mixture normally travels the lower path (through valves 70 and 72 and filter 74) through another valve 78 to a lubricant manifold 80 through a pipe 82. A reverse flow of water may be induced through the filter 74 to clean the same by closing valve 70 and opening valve 76. Additionally, a valve 84, positioned between the filter system 68 and a water source 86 and controlled by a control arrangement 88, must be opened for permitting water to enter the system in the reverse flow direction and clean the filter 74. This purge or flush arrangement will be discussed in further detail below.

The mixture from the lubricant manifold travels a short pipe 90 before splitting into three distinct spray paths 92, 94 and 96. The pipe 90 has a valve 98 included thereon and has another valve 100, another control 102 and a source of water 104 attached to it as indicated in FIG. 2. The three spray paths 92, 94 and 96 all lead to spraying units 106, 108 and 110, respectively. The spraying units all have a common junction, i.e., the lubricant manifold for insuring a constant equal mixture flow to each of the three spraying units. The specific construction details of the spraying units will be discussed below. The spraying units 106, 108, and 110, in addition to being selectively supplied with graphite mixture are also constantly supplied with compressed air from the source 64 through a regulator 112. The compressed air is split into three distinct paths 114, 116 and 118 and terminate at the three spraying units 106, 108 and 110, respectively. The spraying units are positioned about the mandrel in an equally spaced relationship, each having a subtended coating angle of approximately 120°. As a result, the whole bar is adequately covered by the graphite mixture. Applicants have employed this spraying configuration with success. This is not meant to imply, however, that more or fewer than three units may be employed.

Positioned proximate the application system is a "switch on" mechanism 120 and a "switch off" mechanism 122 each of which are connected to solevoid 62 by lines 124 and 126, respectively. The switches 120 and 122 may be of any convenient variety, e.g., proximity, heat sensitive, leaf spring type, or any other variety which will selectively switch the solevoid 62 on as a mandrel passes into the graphite lubricant application system and off as it leaves. Applicants have employed heat sensitive switches in this area with great success.

The operation of the above-described system should be obvious from the preceeding description. The specific manner of how the spray nozzles operate will be treated below. The remaining function of the system which has not yet been described, but which is of the utmost importance, is the cleaning or flushing of the system whenever the system is inoperative for a given period of time. Such periods of inactivity may be the result of any one of a number of causes, however, it should be recognized that cleaning even without these causes may be desirable in any case. It has been previously noted that the graphite mixture 54 has a heavy sludge-like consistency and has a definite propensity to clog whatever system it is used in, the present spray application system being no exception. Accordingly, clogging of the system must be prevented in order to provide a practical and efficient substitute to a black oil lubricant system. It must also be emphasized that the solution to this clogging problem must also take into account the conservation of lubricant with the system and the total mill.

The two water sources 86 and 104, connected to the rest of the present system by valves 84 and 100, in turn controlled by controls 88 and 102, provide the necessary flushing or cleaning of the system on either a specific periodic basis or on any basis necessitated by the lubricant/system interface. The period or frequency of cleaning, in the end, is dictated by the clogging propensity of the graphite lubricant within the particular system it is being employed. Consequently, the times referred to within this description are meant as examples only and may or may not have any bearing upon other particular application arrangements. The two cleaning arrangements shown may be used simply or in combination to provide the necessary flushing of the application system.

For purposes of brevity, only one flush arrangement will be described in detail, the operation of the other being substantially the same as the one discussed. The water source 104 is connected to the application system through valve 100 at a point close to the lubricant manifold. When the application system has been shut down for a full 30 minutes the control 102, which may be automatic, semiautomatic or manual operates to open the normally closed valve 100 and permit water from the source to flow toward the lubricant manifold 80 and to the spraying units. The water source input through valve 100 is made as close to the spray units as possible in order to prevent wasting of the lubricant already in line when the flushing action takes place, water from source 104 flushes the lines 92, 94 and 96 of all lubricant mixture, thereby preventing its clogging the lines. The amount of lubricant within these lines, which is small, is flushed from the system and, unless recovered by a specific recovery system, are lost. However, the water introduced into the line 90 also flows toward the tank 52 through the piping and valves described above and passes, through appropriate passages within the air pump 56, back into the tank 52 and is saved. Upon cleaning of the lines, the control unit closes the valve 100 and the system is flushed clean and again ready for application of the lubricant mixture to the mandrels.

While the system described above operates on a thirty minute inactivity of the application system (the system being inoperative for approximately 15–20 seconds between successive mandrels when properly operating), this does not have to be the case in each and every instance. For example, the given time of inactivity necessary to activate the control 102 might be far greater or less, the latter limit being a situation in which the system is flushed between lubricant applications to successive mandrels. Under this latter extreme case, some lubricant recovery system would be needed to recover the lubricant being flushed from the lines 92, 94 and 96 after each application. Under drastic clogging conditions, this extreme remedy of constant flushing might be necessitated.

Figure 3:
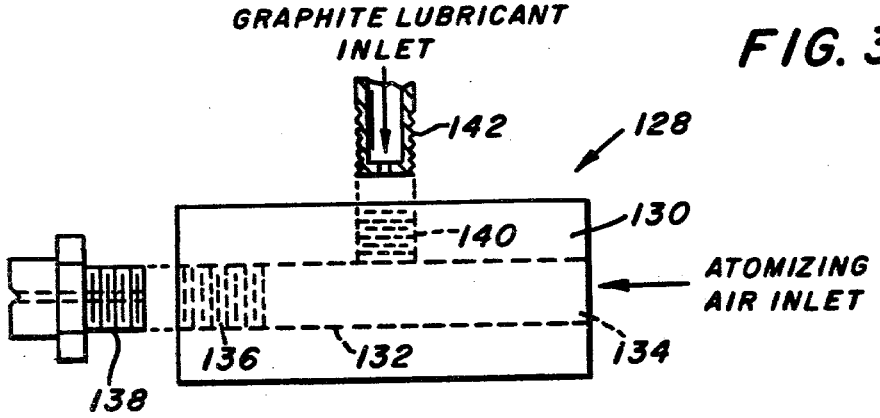
FIG. 3 is a sectional side elevational view of one embodiment of an application spray nozzle according to the present invention.

The importance of preventing clogging of the thick sludgy graphite lubricant mixture cannot be emphasized enough. Clogging of any portion of the system, leading to down time and cleaning of parts, cannot be tolerated within an ongoing and "constantly" operating mill such as the one described above. If the graphite clogs, as has happened before in the absence of the present system, the mill must be shut down. A system susceptible to such shut downs does not have a long life in a mill of this type. Moreover, the difficulties encountered in cleaning such a system assume a normally operating and efficient lubricant application system. The spray application of the heavy clogging lubricant is just as difficult as the problem of cleaning and will now be discussed. The spraying of the lubricant mixture, and therefore the success or failure of the complete application system, depends upon the success or failure of the spraying nozzles. FIG. 3 is one embodiment of a nozzle employed within the present system which has succeeded. Looking to FIG. 3, there is shown a sectional view of a nozzle according to the present invention. The spray nozzle, indicated generally at 128, is configured having a housing 130 which includes a bore or hole 132 formed therethrough. The bore 132 has an air input end 134 and a mixture output end 136 into which is screwed a conventional spray nozzle 138 having an aperture (not shown) extending therethrough. Intersecting bore 132, proximate the center of its length, is a second bore of hole 140 oriented normal to the bore 132. A graphite lubricant inlet 142 is provided, the bore 140 being configured to receive the lubricant inlet 142 therein for introducing the lubricant into the nozzle. In operation, air from the compressed air source (subsequent to proper regulation) is passed into the nozzle through end 134 of bore 132. The lubricant is introduced through inlet 142 and bore 140 in a direction substantially normal to the direction of movement of the atomizing air. The configuration of the nozzle as shown causes the atomization of the heavy lubricant mixture and results in its simplified passage through the remainder of bore 132, through the spray nozzle 138 and onto the mandrel passing therepast. Due to the speed of the mandrel through the present application system, spraying is the only practical and efficient way of applying the lubricant. Additionally, the spray nozzle configuration just described is a convenient and efficient method of applying the lubricant through the nozzle.

It should be seen that the present graphite lubricant application system and method provides a simplified, clean, efficient and practical substitute for the environmentally degrading and dangerous black oil lubricant system for a seamless pipe mill. The arrangement advantageously provides for an improved system in which graphite lubricant is applied in a more efficient manner with a greater application area and less waste. The primary advantages of an application system of this type may be measured in efficiency, cleanliness and worker safety. In the present case, all of these advantages are certainly fulfilled.

Accordingly, while certain changes may be made in the above-noted system and vehicle without departing from the scope of the invention herein involved, it is intended that all matter contained in the above description or shown in the accompanying drawings shall be interpreted as illustrative and not in a limiting sense.

We claim:

1. The method of lubricating mandrels employed within a seamless pipe mill with a nonsmoking lubricant, said method comprising:

moving the mandrels from an exit portion of the seamless pipe mill toward an entrance end thereof;

cooling the mandrels as they are moved from the exit end of the mill toward the entrance end;

aligning the mandrels along a longitudinal axis parallel to a line of travel of the mandrel within the seamless mill; and selectively applying a coating of graphite and water mixture, with a binder additive, to each successive mandrel just prior to its insertion within the pipe mill and a seamless pipe shell.

2. The method according to claim 1 in which the step of selectively applying such mixture to each successive mandrel includes selectively spraying each mandrel with such mixture when each mandrel approaches a given point with respect to an application point and ceasing to apply such mixture to a mandrel when the mandrel has passed another given point.

* * * * *